United States Patent [19]

Davidson

[11] 4,345,687

[45] Aug. 24, 1982

[54] COLLAPSIBLE HEADLAMP CARTON AND BLANK FOR FORMING SAME

[75] Inventor: Thomas L. Davidson, Uncasville, Conn.

[73] Assignee: Robertson Paper Box Co., Inc., Montville, Conn.

[21] Appl. No.: 225,327

[22] Filed: Jan. 15, 1981

[51] Int. Cl.[3] ..... B65D 85/42

[52] U.S. Cl. ..... 206/418; 206/583; 206/806

[58] Field of Search ..... 206/806, 418, 419, 420, 206/421, 583, 476, 461, 485, 486; 229/27, 15

[56] References Cited

U.S. PATENT DOCUMENTS

| | | | |
|---|---|---|---|
| 2,980,244 | 4/1961 | Gendre | 206/418 |
| 3,240,417 | 3/1966 | Andrenini | 206/418 |
| 3,400,879 | 9/1968 | O'Brien et al. | 206/418 |
| 3,968,924 | 7/1976 | Tyrseck | 206/418 |
| 4,260,059 | 4/1981 | Roccaforte | 206/418 |

*Primary Examiner*—Joseph Man-Fu Moy
*Attorney, Agent, or Firm*—Cesari and McKenna

[57] ABSTRACT

A collapsible carton for containing and securely retaining an automobile headlamp comprises four wall panels hinged together to form a tube and an interior lamp-retaining strap hinged at its opposite ends to opposite carton wall panels. The strap has a two-ply construction along the segment thereof which engages around the lamp so that it does not tear upon insertion of the lamp into the carton. Also, the strap includes a special oblique fold line which assures that the strap opens out into the proper position when the carton is erected. A blank for forming such a carton is also disclosed.

13 Claims, 6 Drawing Figures

Fig. 1
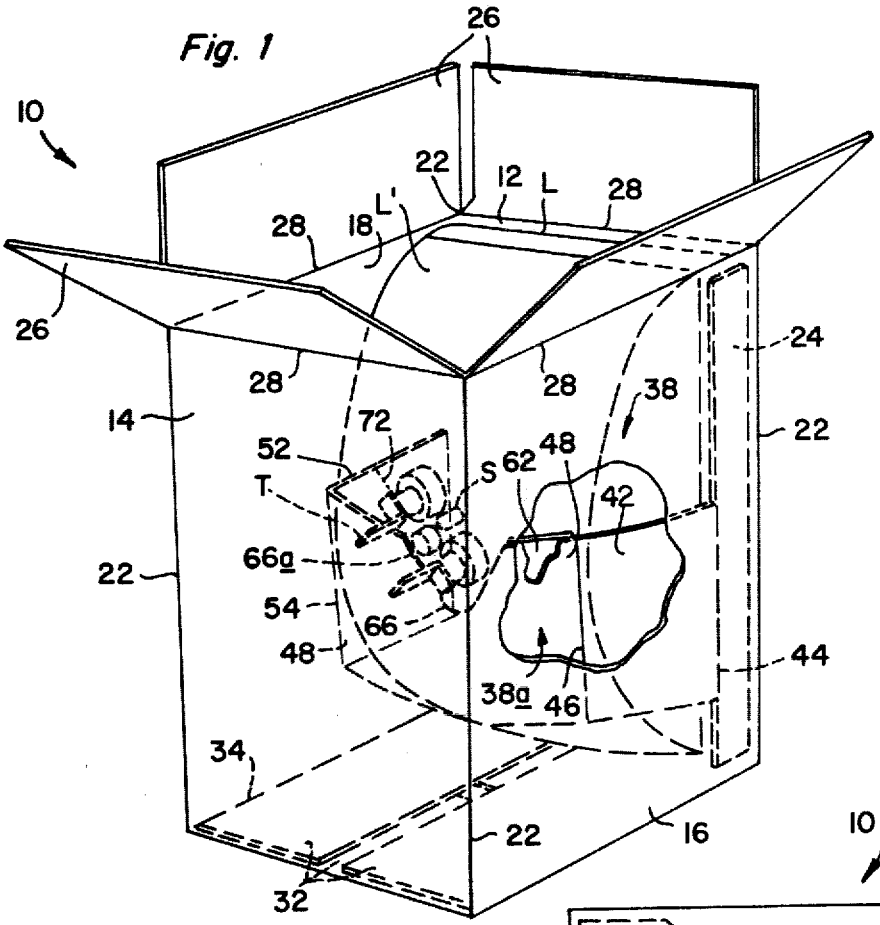
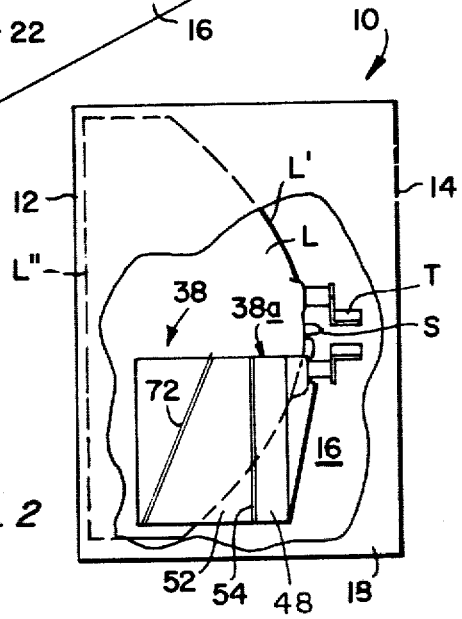
Fig. 2

COLLAPSIBLE HEADLAMP CARTON AND BLANK FOR FORMING SAME

This invention relates to a carton. It relates more particularly to a collapsible carton which is particularly adapted to contain and protect an automobile headlamp during handling and while it is on the shelf and also to a blank for forming such a carton.

BACKGROUND OF THE INVENTION

Present day automobile headlights are in the form of sealed beam units. In most cases, the headlamp envelope has a generally round or rectangular front wall and a curved rear wall. Bayonnet-type electrical connectors project from the rear wall of the envelope by which the unit is connected electrically to the automobile's electrical system. Also projecting from that rear wall in the midst of the terminals is a hollow, thin-walled sealed glass stem by which a vacuum was drawn in the sealed beam unit at the time of its manufacture. That stem is the most fragile part of the unit and must be protected.

One collapsible carton used extensively heretofore to contain a headlamp such as this has four hinged-together walls which square up to form a generally rectangular tube. Cover flaps are hinged to the upper and lower edges of the walls which suffice to close off the upper and lower ends of the carton.

Also, in order to secure the headlamp within the carton so that it cannot move around, a flexible strap is provided inside the carton having its opposite ends secured to opposite walls of the carton. This strap folds out automatically when the carton is erected. When a headlamp is inserted into the carton between the strap and the opposite carton wall, the strap flexes to conform to the curved rear wall of the lamp and, in doing so, presses the front face of the unit flush against the adjacent carton wall so that the lamp is captured securely between the strap and that wall. Usually also, a notch is provided in the strap midway along its length to accommodate the terminals and glass stem projecting from the rear wall of the headlamp.

One problem which has plagued the prior cartons of this general type stems from the fact that when the headlamp unit is inserted into the carton either by man or machine, sometimes the unit is pushed too far into the carton with the result that the lamp securing strap tears at some location along its length where the stress is greatest. Resultantly, the headlamp is no longer secured firmly within the carton and is free to move about therein.

In this connection, it should be borne in mind that the front face of the headlamp may be rectantular in which case its edges are positioned right at the edges of the opposing carton wall. Furthermore, it is customary to stack a number of headlamp-containing cartons in larger boxes or crates for shipment. This means that, if the cartons are all oriented the same way in the crate, the edges of the rectangular lamps in adjacent cartons lie right next to one another. Consequently, if a lamp is free to move within its carton, it can be driven against a corner of the carton with sufficient force to impact an edge of a bulb in an adjacent carton with the result that one or both bulbs may crack. Since, in order to operate properly, the headlamp must be under a vacuum, the slightest leak in the glass envelope ruins the headlamp.

Prior cartons of this general type are disadvantaged also in that, when the carton is squared up, the headlamp-retaining strap does not always open out into its correct position. This is particularly so with the larger cartons. In other words, when the carton is in its knocked-down condition, which is its condition after the folding and glueing operations and when a number of such cartons are shipped, the lamp-retaining strap is sandwiched between the carton walls. In some cases, when the carton is erected from that flattened condition, the strap unfolds the wrong way so that it does not occupy its proper position within the carton, but rather lies too close to the carton walls. Resultantly, the strap is in no condition to retain a headlamp inserted into the carton.

SUMMARY OF THE INVENTION

Accordingly, it is an object of the present invention to provide an improved collapsible carton for containing and retaining an automobile headlamp.

Another object of the invention is to provide a carton of this type having an improved and strengthened interior lamp-retaining strap.

Another object of the invention is to provide a collapsible headlamp carton whose internal lamp-retaining strap assumes the proper position within the carton when the carton is squared up.

Another object of the invention is to provide a collapsible carton for a headlamp which provides better protection for the lamp during shipping and handling.

A further object of the invention is to provide a headlamp carton which can be made from a single blank utilizing a minimum amount of board material and a minimum number of folding and glueing steps to form the carton.

Still another object of the invention is to provide a blank for forming a headlamp carton having one or more of the above characteristics.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the present carton has much in common with prior headlamp cartons of this general type in that it has four hinged-together rectangular panels which, when squared up, form a tube. Also, the usual cover flaps are provided at the upper and lower edges of the panels to close off the upper and lower ends of the carton. The present carton also has an internal lamp-retaining strap connected at its opposite ends to opposite carton walls.

The present carton differs from the prior ones, however, in that a panel is hinged to the lamp-bridging portion of the strap which panel extends initially toward an open end of the carton. When the carton is made up, that panel is folded back against the bridging portion of the strap and adhered thereto, thereby doubling the thickness of the strap along the segment thereof which engages behind the rear wall of the headlamp and which thus suffers the greatest tensile stress when the lamp is inserted into the carton.

Also, to insure that the thus stiffened lamp-retaining strap opens out properly when the carton is squared up, particularly in the case of the larger size cartons, a special diagonal fold line is formed in the strap adjacent one end thereof. This fold line or hinge causes the adjacent strap segment to fold obliquely in such a manner as to predispose the stiffened two-ply bridging portion of the strap to open up away from the carton walls when the carton is erected. But for this special extra hinge, the stiffened strap may bend or unfold in the wrong direction when the box is erected so that the strap occupies a position excessively close to the carton walls. When the strap is in that incorrect position, it obviously cannot secure a headlamp within the carton and, in some cases, it may even prevent a lamp from being inserted into the carton.

With these seemingly small modifications to the lamp-retaining strap in the prior carton structure, vastly superior protection is given to the contained lamp. With my construction, the strap is always in the correct position to receive and retain a lamp inserted into the carton. Moreover, the strap does not become torn during the lamp insertion process so that it firmly fixes the position of the lamp within the carton. Consequently, even if the carton is shaken or jostled during handling, there is little likelihood of the lamp shifting within the carton to the extent that its front edge smashes against the edge of another lamp in an adjacent carton. Resultantly, by using the present carton construction, the incidence of lamp damage during such handling is kept to a minimum.

Additionally, in one carton embodiment, the carton panel structure also forms a shadow box which displays the carton contents in a particularly effective way so that the carton itself has considerable merchandising appeal.

My improved headlamp carton is constructed from a single carboard blank using a minimum amount of board stock. This is because many such blanks can be interfittingly laid out on a web in such a way as to minimize the amount of board waste between the blanks. Also, the carton is made up using a minimum number of folding and glueing operations. Consequently, the overall cost of the carton is kept to a minimum.

BRIEF DESCRIPTION OF THE DRAWINGS

For a fuller understanding of the nature and objects of the invention, reference should be had to the following detailed description, taken in connection with the accompanying drawings, in which:

FIG. 1 is a perspective view with parts cut away showing a collapsible headlamp carton embodying the principles of this invention;

FIG. 2 is a side elevational view thereof on a smaller scale and with parts broken away;

DESCRIPTION OF THE PREFERRED EMBODIMENTS

Figure 3:
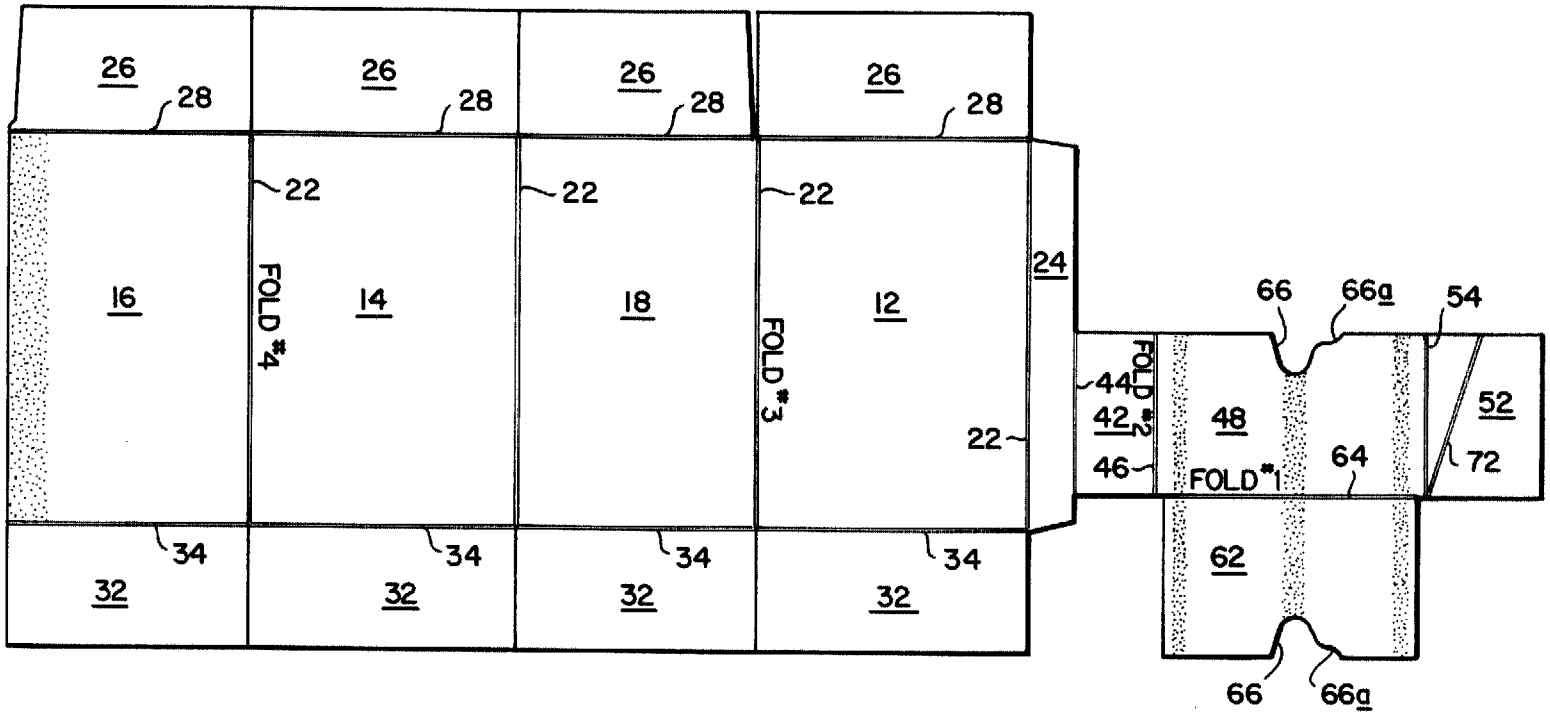
FIG. 3 is a top plan view showing the blank from which the FIG. 1 carton is made.

Referring to FIGS. 1 and 2 of the drawings, the carton indicated generally at 10 comprises a front wall panel 12, a rear wall panel 14 and a pair of side wall panels 16 and 18. These panels are hinged together at hinge lines 22 to form a generally rectangular tube. A glue flap 24 hinged at 22 to the free side edge of panel 12 is adhered to the inside surface of panel 16 to maintain the integrity of the carton. Also, the usual rectangular cover flaps 26 are hinged to the upper edges of the aforesaid four panels along hinge lines 28 and corresponding bottom cover flaps 32 are hinged at 34 to the lower edges of those panels to close off the upper and lower ends of the carton.

Carton 10 has an internal lamp-retaining strap indicated generally at 38. The strap includes a generally rectangular panel 42 hinged at 44 to the free side edge of glue flap 24 near the lower end of the carton. The total width of panel 42 and the glue flap is approximately one-half the rearward extent of the carton. Hinged to the free side edge of panel 42 along hinge line 46 is a rectangular panel 48 which extends substantially the full width of the carton.

As best seen in FIG. 2, the opposite side edge of panel 48 is, in turn, connected to a panel 52 at hinge line 54, the panel 52 width being about one-half the rearward extent of the carton. Panel 52 is adhered to the inside face of wall panel 18 near the hinge line 22 of that panel with the front wall panel 12. Thus the strap 38 extends substantially the entire width of the carton and is located in a vertical plane situated approximately half way along the rearward extent of the carton.

Additionally, the strap 38 includes a reinforcing bridging panel 62 having substantially the same dimensions as panel 48. Panel 62 is hinged at 64 (FIG. 3) to a free edge of panel 48 and is folded flush against and adhered to panel 48 so that the bridging segment **38*a* of the strap 38 extending between the carton side walls 16 and 18 constitutes two plies of the board material from which the carton 10** is constructed.

As best seen in FIG. 1, one free edge of strap segment **38*a*, herein the upper edge, is formed with a vertical generally semicircular notch 66 and a contiguous smaller diameter semicircular notch 66*a*. These notches are arranged so that when a headlamp L is inserted into carton 10, a lamp terminal T and stem S are received in the notches 66 and 66*a*. The shape and location of the notches are arranged so that the lamp L can be inserted either end first into the carton and still a terminal T and stem S will be received in the notches 66 and 66*a***.

The lamp L illustrated specifically is rectangular. It could, however, be round. In either event, when the lamp L is inserted into the carton from the upper end thereof as depicted in FIG. 1, the curved rear wall L′ of the lamp engages behind the strap bridging segment **38*a* thereby deforming and deflecting that segment toward the carton rear wall 14. However, because of its extra strong two-ply construction, that strap bridging segment 38*a*** has little tendency to tear.

As the lamp is pushed further into the carton, the strap 38 deforms so that its end panels 42 and 52 are pulled away from the carton side wall panels 16 and 18 respectively. Resultantly, when the lamp is seated, the strap conforms generally to the cross-sectional shape of the lamp rear wall L′. This flexing of the strap biases the lamp L so that its front wall L″ is pressed tightly against the carton front wall panel 12 as best seen in FIG. 2. Consequently, the lamp is firmly clamped within the carton so that it has no tendency to move about therein even when the carton is jostled or shaken.

Preferably the height of the strap 38 upper edge is such that when the lamp L is inserted into the carton from above and retained by the strap, the lower edge of the lamp is spaced approximately one-half inch above the lower end of the carton. Consequently, when the carton is stacked on end in a large crate, if the crate is dropped, the lower edge of the lamp in one carton will not be thrust against the upper edge of the lamp in the underlying carton. Resultantly, there is minimum chance of the lamps being damaged in transit.

The carton 10 is formed from a single cardboard blank illustrated in FIG. 3. An array of such blanks can be laid out on the board web so that they interfit. Resultantly when the blanks are struck from the web, there is minimum wastage of board material between blanks.

Figure 4:
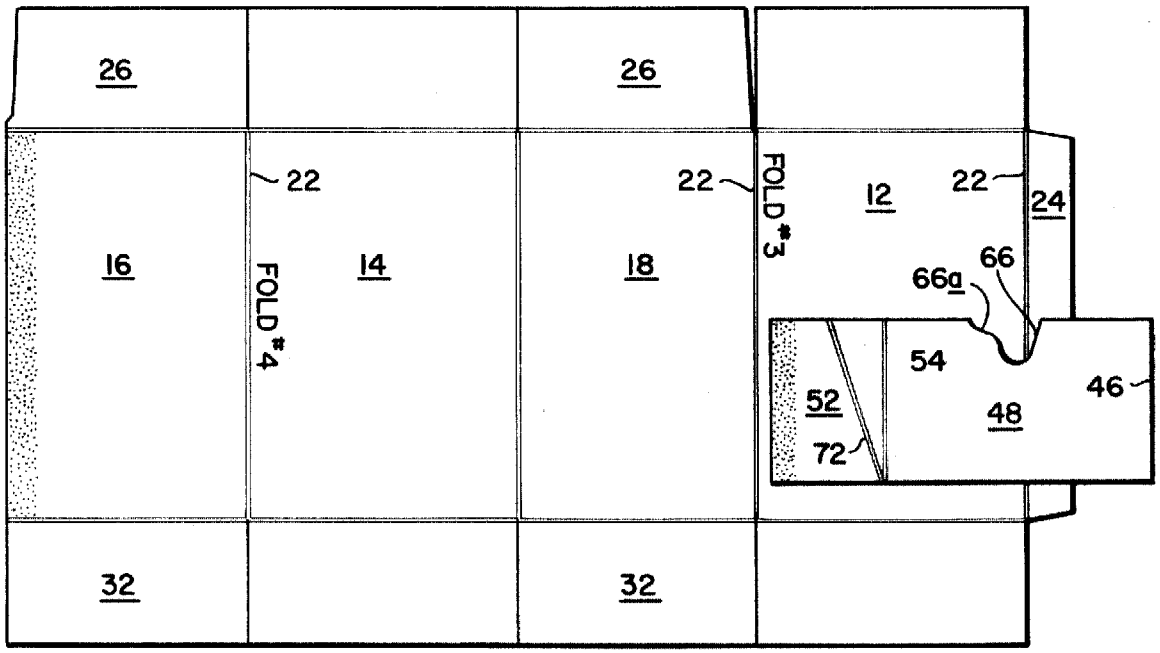
FIG. 4 is a similar view of the FIG. 3 blank partially folded to form the carton.

The carton is made up following the folding sequence indicated in FIG. 3. More particularly, after glue is applied to the blank as indicated by stippling in that figure, the blank is folded first along hinge line 64 so that strap panel 62 adheres to panel 48. Then the blank is folded along hinge line 46 so that panels 48 and 52 overlie panel 12 as shown in FIG. 4. Next, glue is applied to panel 52 as shown by stippling in FIG. 4 and the blank is folded along hinge line 22 between panels 12 and 18 so that panel 12 overlies panel 16 and panel 52 adheres to the right edge margin of panel 18. Finally, panel 16 is folded so that its left edge margin adheres to glue flap 24 thereby completing the carton. The carton is normally shipped in quantity in this flattened or knocked-down condition with the various panels of the strap 38 being sandwiched between the carton wall panels. The carton is erected by pressing opposite corners thereof toward one another which tends to square up the carton with the result that the interior strap panels open up as illustrated in FIG. 1.

In order to minimize any tendency for the strap 38 to bend or open in the wrong direction when the carton is squared up, an oblique fold line or hinge 72 is desirably formed in the strap panel 52, particularly in the case of the larger size cartons. The fold line 72 is angled so that one end is situated more or less at the lower end of the glue flap fold line 54, while its opposite end is positioned approximately half way between the upper end of that fold line and the side edge of panel 52. In this way, fold line 72 makes an angle of about 15 to 20 degrees with hinge line 54.

When the carton is squared up, the panel 52 folds along the oblique fold line 72 just enough to predispose the strap 38 to open up in the manner illustrated in FIGS. 1 and 2 rather than to bend in the opposite direction about its hinge line 54 so that the strap panels 48 and 52 lie adjacent the carton front and side wall panels. That sometimes does occur when there is no fold line or when the line is perpendicular to the length of the strap. Consequently, when the illustrated carton 10 of this invention is set up, it is assuredly in a condition to receive an endwise-inserted lamp L.

It should be appreciated at this point that the strap reinforcing panel 62 can be hinged to the opposite free edge of panel 48. Also, the notches 66 and **66*a* can be formed in panels 48 and 62 adjacent hinge line 64 so that, when the panel 62 is folded flush against panel 48, the notches in the two panels are in register. A strap arrangement such as this is shown in FIGS. 5 and 6**.

Figure 5:
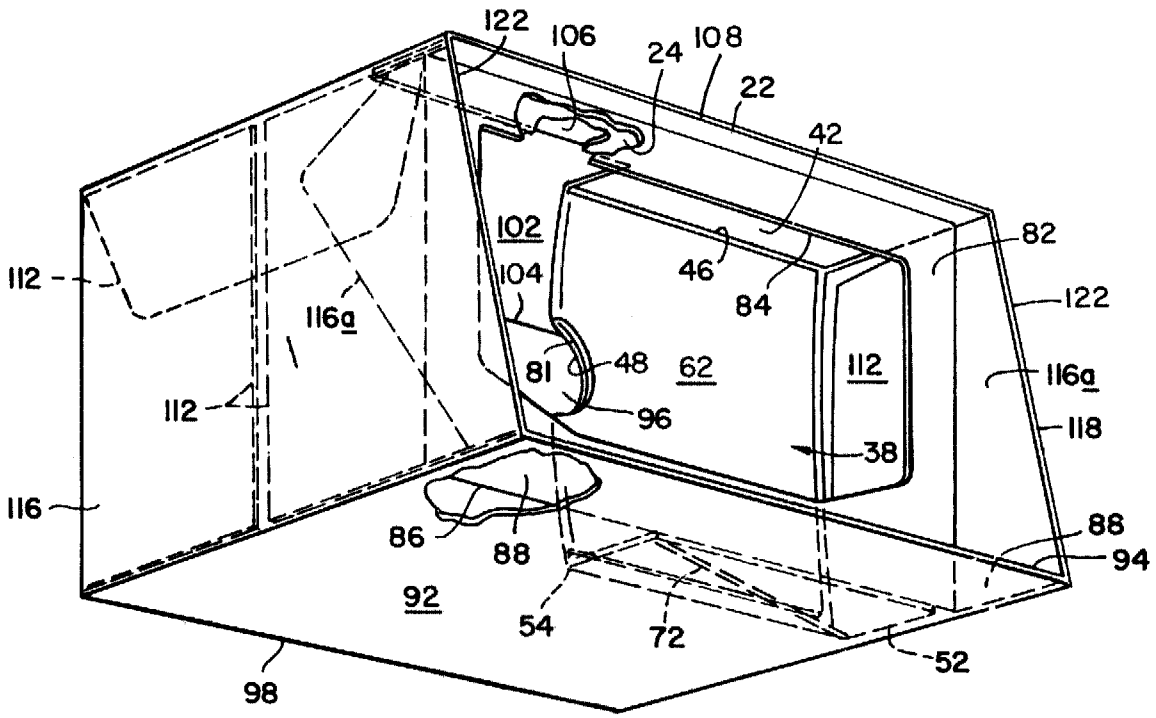
FIG. 5 is a perspective view of another embodiment of the carton.
Figure 6:
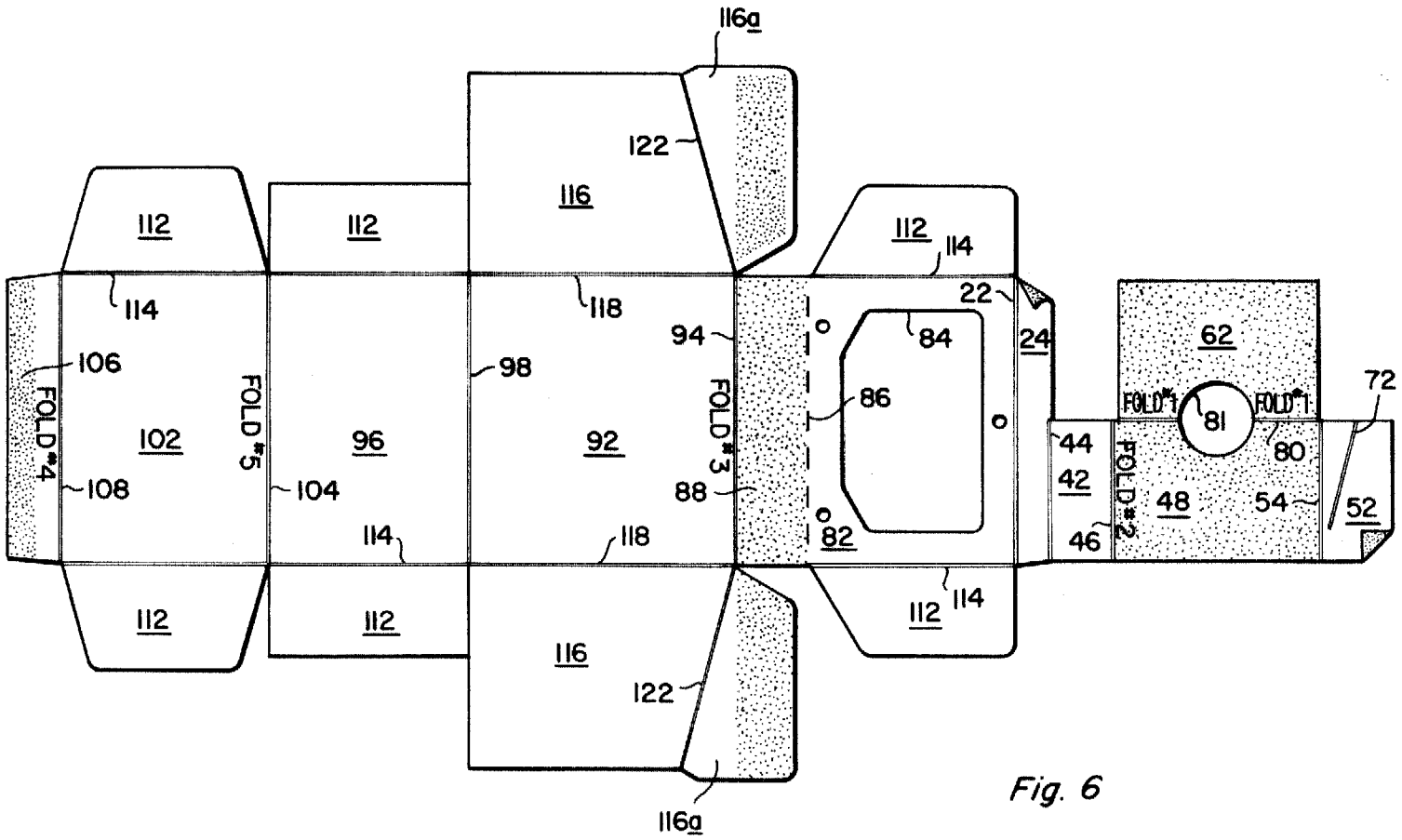
FIG. 6 is a top plan view of the blank used to form the FIG. 5 carton.

FIGS. 5 and 6 illustrate another carton embodiment utilizing the principles of this invention. Aside from the slight differences in the strap construction just noted, the FIG. 5 carton differs from the FIG. 1 version mainly in that it is constructed to form a shadow box for displaying the carton contents in an eye-catching and effective manner. This carton embodiment also securely retains a headlamp within the carton and prevents the lamp from moving about therein during shipment.

Since the FIG. 5 carton is intended to repose on its side to most effectively display the carton contents, its wall panel and cover flap structures are somewhat different from those of the FIG. 1 carton. However, its internal strap structure 38 is more or less the same as that of the FIG. 1 carton and accordingly those panels are identified by the same numerals.

More particularly, hinged to glue flap 24 is a strap panel 42, the opposite edge of which is hinged to the bridging panel 48. The opposite side edge of the bridging panel is hinged at 54 to the panel 52 containing an oblique fold line 72. The reinforcing panel 62, instead of being hinged to the lower edge of panel 48, is hinged at 80 to the upper edge thereof. Also a lamp terminal-receiving opening 81 is formed adjacent that hinge line instead of at the free edges of the panels 48 and 62 as shown in FIG. 3.

The carton front wall panel 82 is hinged at 22 to the glue flap 24. The front wall panel is also formed with a rectangular opening 84 through which one can see the carton contents. Connected to the opposite free edge of panel 82 along hinge line 86 is a connector panel 88 whose opposite edge is, in turn, connected to the carton bottom panel 92 along a hinge line 94. Panel 92 is relatively deep so that its front edge projects forwardly of panel 82 with the connector panel 88 being located flush against and adhered to the upper surface of panel 92 at the leading edge margin thereof.

Carton rear wall panel 96 is hinged at 98 to the bottom wall panel 92 and the carton top wall panel 102 is hinged at 104 to the opposite edge of rear wall panel 96. Finally, a relatively narrow rectangular panel 106 is hinged at 108 to the opposite edge of panel 102. Panel 106 is folded flush against panel 102 and adhered thereto so that when the box is made up, the hinge 108 forms a finished surface at the upper front edge of the carton as shown in FIG. 5.

Cover flaps 112 which are more or less the same as the cover flaps in the FIG. 1 carton are hinged at 114 to the opposite free edges of panels 82, 96 and 102. The cover flaps hinged to the opposite edges of bottom wall panel 92 are somewhat different in order to enable the carton to provide a shadow box effect. More particularly, a flap 116 is connected along a hinge line 118 to the opposite free edges of panel 92. Each flap 116 has a generally triangular extension **116*a* which is connected to flap 116 along a hinge line 122 which lies at an angle relative to hinge line 94. Thus the leading edges of flaps 116 and their extensions 116*a* form wings or ears which project forwardly of the carton front wall panel 82 forming the sides of the shadow box. Thus, in effect, the carton front wall panel 82 is set into the recess formed by the forwardly projecting bottom wall panel 92 and the leading edge margins of the cover flaps 116**.

The FIG. 5 carton is constructed from the blank illustrated in FIG. 6 following the indicated folding sequence with the glue being applied to the blank as indicated by the stippling. First, panel 62 is folded flush against and adhered to panel 48. Then, the blank is folded at hinge line 46 so that those panels overlie panel 82. Next, the blank is folded at the hinge line 94 as well as at the hinge lines 122 so that connector panel 88 adheres to panel 92 and so that the flap extensions **116*a* overlie and adhere to flaps 116. Next, the panel 106 is folded at line 108 so that it lies flush against and adheres to panel 102. Finally, panel 102 is folded at hinge line 104 so that the panel 106 adheres to glue flap 24** thereby completing the carton.

When the carton is erected as shown in FIG. 5, the various panels of the internal strap 38 open out into positions to securely retain a lamp inserted endwise into the carton. As such, this carton embodiment has all of the advantages of the FIG. 1 carton. In addition, it provides a distinctive display for the carton contents which are visible through the recessed front wall opening 84. As with the FIG. 1 carton, it can be constructed from a single cardboard blank using a minimum amount of board material. Therefore, it should find wide acceptance in the marketplace.

It will thus be seen that the objects set forth above, among those made apparent from the preceding description, are efficiently attained. Also, certain changes may be made in the above constructions without departing from the scope of the invention. For example, the ends of strap 38 can be located at the carton front and rear walls so that the headlamp is oriented sideways in the carton. Therefore, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. In a collapsible carton constructed from a single blank and adapted to contain and retain an automobile headlamp of the type including a series of at least four panels hinged together to form a rectangular tube, a glue flap hinged to the free side edge of the panel at one end of the series for adherence to the free side edge of the panel at the other end of the series to maintain the integrity of the tube; cover flaps hinged to the opposite free edges of the wall panels for closing off the open ends of the tube; the improvement comprising a lamp-retaining strap inside the carton, said strap including a pair of similar panels hinged at corresponding edges thereof to opposite carton wall panels, a bridging panel hinged at its opposite edges to free edges of said pair of panels so as to extend between said opposite carton wall panels, a strap reinforcing panel hinged to a free edge of said bridging panel perpendicular to its hinged connections to said pair of panels, said reinforcing panel having substantially the same dimensions as the bridging panel so that it can be folded along its said hinge line flush against said bridging panel, and means for adhering the reinforcing panel to the bridging panel to form a two-ply strap segment extending between said pair of panels so that when a headlamp is inserted into the carton and engaged under said strap, said strap has little tendency to tear.

2. The carton defined in claim 1 and further including means defining an opening in a free edge of said strap for receiving terminals projecting from the rear wall of a lamp inserted into the carton.

3. The carton defined in claim 2 wherein said opening is formed by striking out material from said bridging panel and said reinforcing panel at the hinge between those two panels.

4. The carton defined in claim 2 wherein said opening is formed by striking out material from the bridging panel and the reinforcing panel at the edges thereof remote from the hinge line between those two panels.

5. The carton defined in claim 1 wherein the hinged connection of one panel in said pair of panels to its adjacent wall panel is angled with respect to the hinge line between said one panel and said bridging panel so as to predispose the strap bridging panel to fold out away from the wall panels properly when the carton is erected.

6. The carton defined in claim 5 wherein the hinge line angle is about 15 to 20 degrees.

7. The carton defined in claim 1 and further including means defining a large opening in at least one of said wall panels.

8. The carton defined in claim 7 wherein selected carton wall panels adjacent said one wall panel overhang said one panel so as to form a shadow box around said opening.

9. The carton defined in claim 7 wherein at least one wall panel adjacent and perpendicular to said one panel overhangs said one wall panel.

10. A blank for a collapsible headlamp carton comprising a lengthwise series of at least four hinged-together rectangular wall panels, a lengthwise series of three hinged-together strap panels hinged to an end of said series of wall panels, said strap middle panel being substantially the same width as the wall panel to which said strap panel series is hinged, said end panels in the strap panel series being narrower than said strap middle panel, and a strap reinforcing panel hinged to a free edge of said strap middle panel, said reinforcing panel having substantially the same dimensions as the strap middle panel.

11. The blank defined in claim 10 and further including a fold line formed in one of said strap end panels, said fold line lying at an angle relative to the hinged connection of said one strap end panel to said strap middle panel.

12. The blank defined in claim 10 and further including coextensive openings formed in said strap middle and reinforcing panels which are in register when said reinforcing panel is folded at its hinge line against said stap middle panel.

13. The blank defined in claim 10 and further including a relatively large opening formed in one of said wall panels.

* * * * *